US008479433B1

(12) United States Patent
Shebaro

(10) Patent No.: US 8,479,433 B1
(45) **Date of Patent: *Jul. 9, 2013**

(54) FIREARM SIGHT WITH HORIZONTAL LINEAR ALIGNMENT INDICATOR

(75) Inventor: Alan Mazin Shebaro, McKinney, TX (US)

(73) Assignee: Shebaro Tactical Consultants Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/570,224

(22) Filed: Aug. 8, 2012

Related U.S. Application Data

(63) Continuation of application No. 13/352,102, filed on Jan. 17, 2012, now Pat. No. 8,261,481.

(51) Int. Cl.
*F41G 1/01* (2006.01)
*F41G 1/12* (2006.01)

(52) U.S. Cl.
USPC ..... 42/113; 42/144

(58) Field of Classification Search
USPC ..... 42/111, 113, 144, 145
See application file for complete search history.

(56) References Cited

U.S. PATENT DOCUMENTS

| | | | |
|---|---|---|---|
| 837,563 | A | 12/1906 | Hartmann |
| 916,058 | A | 3/1909 | Tessey |
| 954,064 | A | 4/1910 | Tufts |
| 1,015,233 | A | 1/1912 | King |
| 2,010,893 | A | 8/1935 | Redfield |
| 2,555,888 | A | 6/1951 | Arthur |
| 3,698,091 | A | 10/1972 | Merrill |
| 3,784,817 | A | 1/1974 | James |
| 4,494,327 | A | 1/1985 | Cullity |
| 5,065,519 | A | 11/1991 | Bindon |
| 5,426,882 | A | 6/1995 | Dornaus |
| 5,638,604 | A | 6/1997 | Lorocco |
| D421,785 | S | 3/2000 | Uhlmann |
| 6,058,615 | A | 5/2000 | Uhlmann |
| 6,058,616 | A | 5/2000 | Bubits |
| D428,102 | S | 7/2000 | Flubacher |
| 6,216,351 | B1 | 4/2001 | Flubacher |
| 6,711,846 | B1 | 3/2004 | Nasef |
| 7,451,566 | B1 | 11/2008 | Price |

(Continued)

FOREIGN PATENT DOCUMENTS

| | | | |
|---|---|---|---|
| FR | 2572802 | A1 | 5/1986 |

OTHER PUBLICATIONS

World Wide Web, http://www.ar15.com/, AR15.Com LLC, printed on Jan. 17, 2012, 2 pages.

(Continued)

*Primary Examiner* — Bret Hayes
(74) *Attorney, Agent, or Firm* — McClure and Associates, PLLC

(57) ABSTRACT

An apparatus comprising a rear sight configured to be coupled with a firearm, the rear sight comprising a left upward member and a right upward member comprising a left horizontal linear alignment indicator and the right upward member comprising a right horizontal linear alignment indicator, wherein a distance between the left horizontal linear alignment indictor and the top surface of the left upward member is less than or substantially equal to the height of the left horizontal linear alignment indicator and a distance between the right horizontal linear alignment indictor and the top surface of the right upward member is less than or substantially equal to the height of the right horizontal linear alignment indicator is disclosed.

22 Claims, 7 Drawing Sheets

U.S. PATENT DOCUMENTS

| | | | | |
|---|---|---|---|---|
| D584,788 | S | 1/2009 | Price | |
| 8,261,481 | B1 * | 9/2012 | Shebaro | 42/113 |
| 2007/0214699 | A1 | 9/2007 | Sne et al. | |
| 2011/0314721 | A1 | 12/2011 | Lamb | |
| 2012/0198750 | A1 * | 8/2012 | Mansfield | 42/132 |

OTHER PUBLICATIONS

World Wide Web, http://www.suresight.com/, Sure Sight, LCC, printed on Jan. 17, 2012, 12 pages.

World Wide Web, http://www.advantagetactical.com, "Advantage Tactical Sight", WrenTech Industries, LLC, printed on Jan. 17, 2012, 1 page.

World Wide Web, http://rockyourglock.com, RockYourGlock.com, LLC, printed on Jan. 17, 2012, 1 page.

World Wide Web, http://rifleoutfit.com, RifleOutfit.com, LLC, printed on Jan. 17, 2012, 1 page.

World Wide Web, http://www.midwayusa.com, MidwayUSA, Inc., printed on Jan. 17, 2012, 1 page.

World Wide Web, http://www.homedefenseweapons.net, Home Defense Weapons, printed on Jan. 17, 2012, 6 pages.

World Wide Web, http://milspecmonkey.com, Mil-Spec Monkey, printed on Jan. 17, 2012, 2 pages.

World Wide Web, http://www.trijicon.com/na_en/index.php, Trijicon, Inc., printed on Jan. 17, 2012, 1 page.

* cited by examiner

FIREARM SIGHT WITH HORIZONTAL LINEAR ALIGNMENT INDICATOR

RELATED APPLICATION

This application is a Continuation of U.S. application Ser. No. 13/352,102 filed Jan. 17, 2012, which is incorporated herein by reference in its entirety.

TECHNICAL FIELD

The present application relates generally to a firearm sight.

BACKGROUND

Firearms have many diverse applications from sport shooting to law enforcement to self-defense to military applications. However, the effectiveness of the firearm may be limited by the effectiveness of the sight by which the shooter aims the firearm.

SUMMARY

Various aspects of examples of the invention are set out in the claims.

An apparatus comprising a rear sight configured to be coupled with a firearm, the rear sight comprising a left upward member and a right upward member with a channel disposed therebetween, the left upward member comprising a left horizontal linear alignment indicator and the right upward member comprising a right horizontal linear alignment indicator, wherein a distance between the left horizontal linear alignment indictor and the top surface of the left upward member is less than or substantially equal to the height of the left horizontal linear alignment indicator and a distance between the right horizontal linear alignment indictor and the top surface of the right upward member is less than or substantially equal to the height of the right horizontal linear alignment indicator is disclosed.

BRIEF DESCRIPTION OF THE DRAWINGS

For a more complete understanding of embodiments of the invention, reference is now made to the following descriptions taken in connection with the accompanying drawings in which.

DETAILED DESCRIPTION OF THE DRAWINGS

An embodiment of the invention and its potential advantages are understood by referring to FIGS. 1A through 4C of the drawings.

FIGS. 1A-1L are diagrams illustrating a sight according to at least one example embodiment. The examples of FIGS. 1A-1L are merely examples of a sight, and do not limit the scope of the claims. For example, a sight may vary in shape, size, configuration, and/or the like.

In the examples of FIGS. 1A-1L, a sight is described that may be used for a firearm. Even though the firearm of FIGS. 1A-1L is a handgun, the handgun is merely as an example, and does not limit the claims in any way. For example, the firearm may be a rifle, a shotgun, and/or the like. The sights described in FIGS. 1A-1L comprise a rear sight and a front sight.

The rear sight and/or the front sight may be configured to be coupled with the firearm. For example, the rear sight and/or the front sight may be non-removeably coupled to the firearm, for example via a weld, a rivet, and/or the like. In another example, the rear sight and/or the front sight may be non-removeably coupled by way of being formed as a part of the firearm. In such an example the rear sight and/or the front sight may be integral to, at least part of, the firearm, for example a part of the firearm that is included in the mold of, at least part of, the firearm during the manufacturing process. In another example, the rear sight and/or the front sight may be configured to be removeably coupled with the firearm. For example, the rear sight and/or the front sight may be configured to be removeably coupled to the firearm by way of a slide-mount coupling, a clamping coupling, a screw mount coupling, and/or the like. In such an example, the rear sight and/or the front sight may be sold already coupled with the firearm, but may be removed after purchase of the firearm. In another such example, the rear sight and/or the front sight may be sold separately from the firearm, to be coupled with the firearm by way of the removable coupling. The rear sight and/or the front sight may be configured to be coupled with the firearm by including a region of the respective rear sight and/or front sight that provides for coupling with the firearm. Such inclusion may be inherent, for example as in the previously disclosed example of the sight being part of the mold of the firearm. Such inclusion may be a distinct part, for example a part that is formed to fit with a sight mount on a firearm. It should be understood that configuration of the coupling of a rear sight and/or a front sight with a firearm may vary, and does not limit the claims in any way.

Figure 1A:
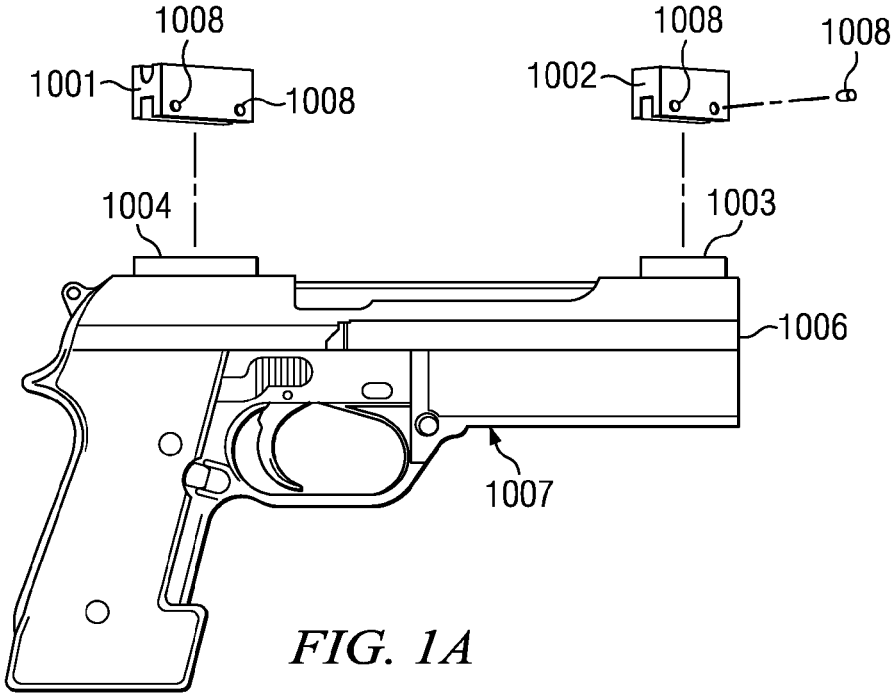
FIGS. 1A-1L are diagrams illustrating a sight according to at least one example embodiment.

FIG. 1A is a diagram illustrating a front sight 1002 and a rear sight 1001 that may be removeably coupled to a firearm 1007 according to at least one example embodiment. In the example of FIG. 1A, the rear sight is configured to be removeably coupled to firearm 1007 by way of rear sight mount 1004. Rear sight mount 1004 may be configured to provide housing for receiving rear sight 1001, an indentation for receiving a pin, screw, and/or the like of rear sight 1001, and/or the like. For example, rear sight mount 1004 may comprise a rail around which rear sight 1001 may slide. In the example of FIG. 1A, rear sight 1001 comprises set-screws 1008, which may be used to affix rear sight 1001 to rear sight mount 1004. Set-screws 1008 may be configured to be received in a threaded or non-threaded indentation of rear sight mount 1004, to increase friction between rear sight 1001 and rear sight mount 1004, and/or the like. Even though the set-screws of FIG. 1A are shown to be the same, one or more of the set screws may differ.

The terms front and rear relate to positioning on the firearm in relation to the output of a barrel 1006 of firearm 1007. The output of a barrel 1006 of the firearm relates to the part of firearm 1007 from which a projectile will be fired. Therefore, the output of the barrel 1006 is considered to be the front of firearm 1007 and remote from the shooter of firearm 1007. Similarly, the rear of firearm 1007 is considered to be remote from the output of the barrel 1006 and proximate to the shooter of firearm 1007.

Rear sight 1001 is configured to be coupled with the firearm at a position on the firearm proximate to the shooter of firearm 1007. Therefore, rear sight mount 1004 is configured to be positioned proximate to the shooter of firearm 1007. It can be seen that rear sight mount 1004 is not at the end of firearm 1007 in a way that rear sight mount 1004 is the closest part of firearm 1007 to the shooter of firearm 1007, but, instead, is at a part of firearm 1007 that is near the shooter. Therefore, even though rear sight 1001 is not positioned to be coupled with firearm 1007 at the end of the rear of firearm 1007, rear sight 1001 is configured to be coupled with firearm 1007 at a position associated with the rear of firearm 1007, in that such position is proximate to such end of firearm 1007. However, in a different example, rear sight mount 1004 may be positioned at the end of firearm 1007 such that rear sight mount 1004 is the closest part of firearm 1007 to the shooter of firearm 1007.

Because the shooter of firearm 1007 utilizes rear sight 1001 to direct a projectile fired by firearm 1007 towards a target, rear sight 1001 is configured to be aligned in substantially the same direction as the output of a barrel 1006 of firearm 1007. The direction of the output of the barrel 1006 of firearm 1007 refers to the direction in which a projectile fired from firearm 1007 will move. In an example embodiment, the direction in which a projectile moves upon exiting the output of the barrel 1006 of firearm 1007 may vary among uses. For example, such direction may vary between a first shot such that the projectile may hit a slightly different part of the target when aimed at an identical part of the target. In other words, the direction of the output of the barrel 1006 of firearm 1007 may vary from the longitudinal axis of the barrel of firearm 1007. Furthermore, it may be prohibitively difficult to ensure that rear sight 1001 is exactly aligned with the output of the barrel 1006 of firearm 1007. For example, such deviation between alignment of rear sight 1001 and output 1006 of firearm 1007 may be acceptable to the shooter, and/or may be compensated by adjustment of front sight 1002. Therefore, even though there may be deviation between alignment of rear sight 1001 and the output of the barrel 1006 of firearm 1007, rear sight 1001 is considered to be aligned in substantially the same direction as the output of a barrel 1006 of firearm 1007 if the variation between alignments is acceptable to a shooter of firearm 1007 in that such variation may be compensated, or in that such variation is within an acceptable range of the shooter of firearm 1007.

Front sight 1002 is configured to be coupled with the firearm at a position on the firearm remote from the shooter of firearm 1007. Therefore, front sight mount 1003 is configured to be positioned remote from the shooter of firearm 1007. It can be seen that front sight mount 1003 is not at the end of firearm 1007 in a way that front sight mount 1003 is the furthest part of firearm 1007 from the shooter of firearm 1007, but, instead, is at a part of firearm 1007 that is away from the shooter. Therefore, even though front sight 1002 is not positioned to be coupled with firearm 1007 at the end of the front of firearm 1007, front sight 1002 is configured to be coupled with firearm 1007 at a position associated with the front of firearm 1007, in that such position is proximate to such end of firearm 1007. However, in a different example, front sight mount 1003 may be positioned at the end of firearm 1007 such that front sight mount 1003 is the furthest part of firearm 1007 from the shooter of firearm 1007.

Because the shooter of firearm 1007 utilizes front sight 1002 to direct a projectile fired by firearm 1007 towards a target, front sight 1002 is configured to be aligned in substantially the same direction as the output of a barrel 1006 of firearm 1007. The direction of the output of the barrel 1006 of firearm 1007 refers to the direction in which a projectile fired from firearm 1007 will move. In an example embodiment, the direction in which a projectile moves upon exiting the output of the barrel 1006 of firearm 1007 may vary among uses. For example, such direction may vary between a first shot such that the projectile may hit a slightly different part of the target when aimed at an identical part of the target. In other words, the direction of the output of the barrel 1006 of firearm 1007 may vary from the longitudinal axis of the barrel of firearm 1007. Furthermore, it may be prohibitively difficult to ensure that front sight 1002 is exactly aligned with the output of the barrel 1006 of firearm 1007. For example, such deviation between alignment of front sight 1002 and output 1006 of firearm 1007 may be acceptable to the shooter, and/or may be compensated by adjustment of rear sight 1001. Therefore, even though there may be deviation between alignment of front sight 1002 and the output of the barrel 1006 of firearm 1007, front sight 1002 is considered to be aligned in substantially the same direction as the output of a barrel 1006 of firearm 1007 if the variation between alignments is acceptable to a shooter of firearm 1007 in that such variation may be compensated, or in that such variation is within an acceptable range of the shooter of firearm 1007.

It should be noted that, even though the example of FIG. 1A describes front sight 1002 and rear sight 1001 being detached from each other, in that there is no direct coupling between front sight 1002 and rear sight 1001, in an example embodiment, front sight 1002 and rear sight 1001 may be attached in that they may be coupled to each other. In such an embodiment, there may be a part of the front sight that extends towards the rear sight and/or a part of the rear sight that extends towards the front sight. In such an embodiment, the front and rear sight may be coupled with each other separate from being coupled with a firearm. For example, the front sight and the rear sight may be attached to each other such that they may be coupled with a firearm as a single attachment to the firearm.

In an example embodiment, rear sight 1001, front sight 1002, and firearm 1007 may each be considered a separate apparatus. In another example embodiment, rear sight 1001 and front sight 1002 may be considered as an apparatus. In yet another example embodiment, rear sight 1001 and firearm 1007 may be considered as an apparatus. In still another example embodiment, front sight 1002 and firearm 1007 may be considered as an apparatus. In even another example embodiment, rear sight 1001, front sight 1002, and firearm 1007 may be considered as an apparatus.

Figure 1B:
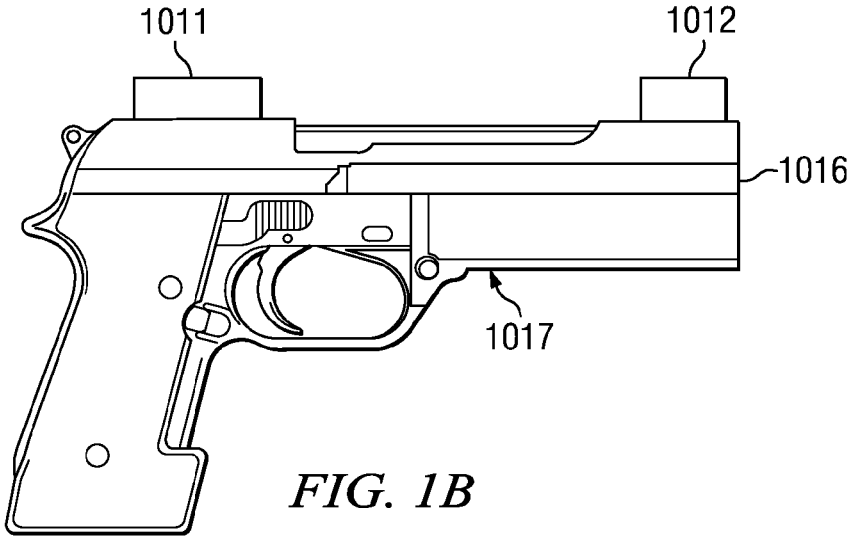

FIG. 1B is a diagram illustrating a front sight 1012 and a rear sight 1011 that are coupled to a firearm 1017 according to at least one example embodiment. In the example of FIG. 1B, front sight 1012 and firearm 1017 may be removeably coupled or non-removeably coupled. In the example of FIG. 1B, rear sight 1011 and firearm 1017 may be removeably coupled or non-removeably coupled.

In an example embodiment, rear sight 1011, front sight 1012, and firearm 1017 may each be considered a separate apparatus. In another example embodiment, rear sight 1011 and front sight 1012 may be considered as an apparatus. In yet another example embodiment, rear sight 1011 and firearm 1017 may be considered as an apparatus. In still another example embodiment, front sight 1012 and firearm 1017 may be considered as an apparatus. In even another example embodiment, rear sight 1011, front sight 1012, and firearm 1017 may be considered as an apparatus.

Figure 1C:
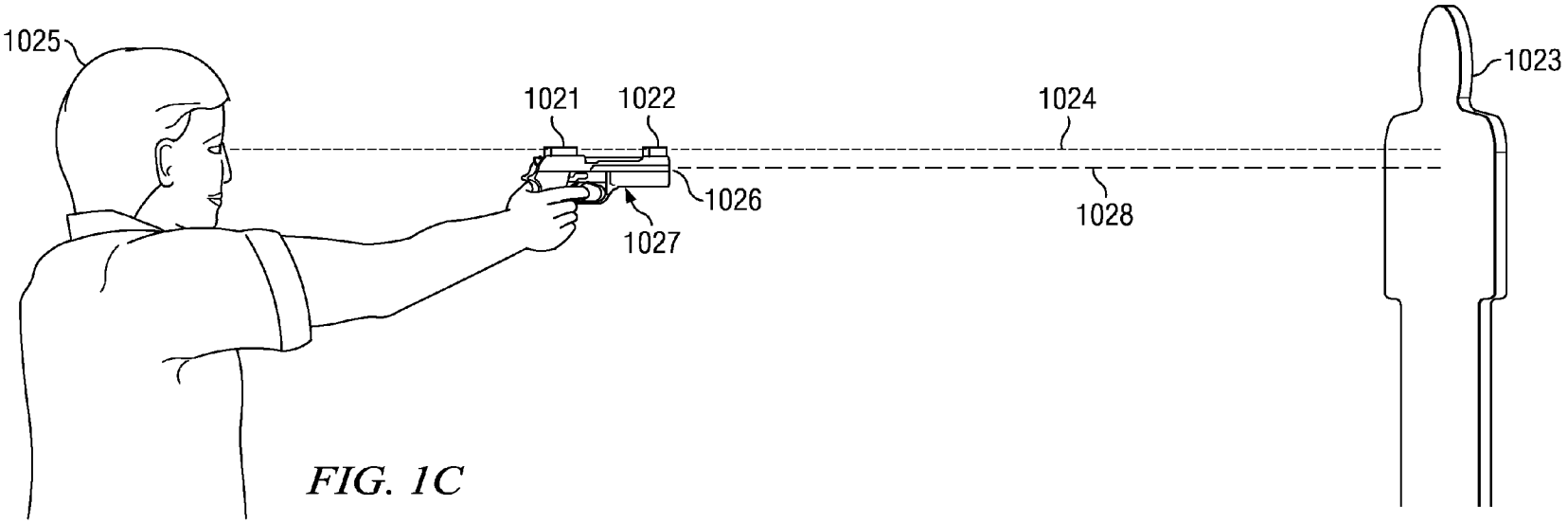

FIG. 1C is a diagram illustrating a front sight 1022 and a rear sight 1021 that are coupled to a firearm 1027 in relation to a shooter 1025 and a target 1023 according to at least one example embodiment. FIG. 1C illustrates longitudinal axis of a barrel 1028 of firearm 1027. The direction of the output of the barrel 1026 of firearm 1027 may be substantially the same as the direction of the longitudinal axis of the barrel 1028 of firearm 1027 extending towards target 1023 and/or away from shooter 1025. As previously described, a difference between direction of the output of the barrel 1028 and the direction of the longitudinal axis of the barrel 1028 may differ insubstantially in that the direction may deviate by an amount that is acceptable to shooter 1025, and/or that the difference is not noticeable by shooter 1025.

In an example embodiment, rear sight is configured to be coupled with the firearm such that sighting direction 1024 of the rear sight is in substantially the same direction as the longitudinal axis of a barrel of the firearm. FIG. 1C illustrates sighting direction 1024 being a direction extending from an eye of shooter 1025, to rear sight 1021, to front sight 1022, to target 1023. In the example of FIG. 1C, sighting direction 1025 is aligned in substantially the same direction as the longitudinal axis of a barrel 1028 of firearm 1027, and/or the direction of the output of the barrel 1026 of firearm 1027. In an example embodiment, sighting direction 1025 may differ insubstantially from the longitudinal axis of the barrel 1028 in that the direction may deviate by an amount that is acceptable to shooter 1025, and/or that the difference is not noticeable by shooter 1025. In another example embodiment, sighting direction 1025 may differ insubstantially from the longitudinal axis of the barrel 1028 in that the direction may deviate by an amount that compensates for the distance between front sight 1022 and the barrel of firearm 1027.

In an example embodiment, rear sight 1021 is configured to be coupled with firearm 1027 such that sighting direction 1024 of rear sight 1021 is in substantially the same direction as the longitudinal axis of a barrel 1028 of firearm 1027. In the same or another example embodiment, front sight 1022 is configured to be coupled with firearm 1027 such that sighting direction 1024 of front sight 1022 is in substantially the same direction as the longitudinal axis of a barrel 1028 of firearm 1027.

Terminology of the front sight and of the rear sight will refer to a sight orientation such that the part of the front sight and the part of the rear sight coupled to the firearm will be considered as the bottom of the front sight and the bottom of the rear sight, respectively.

Figure 1F:
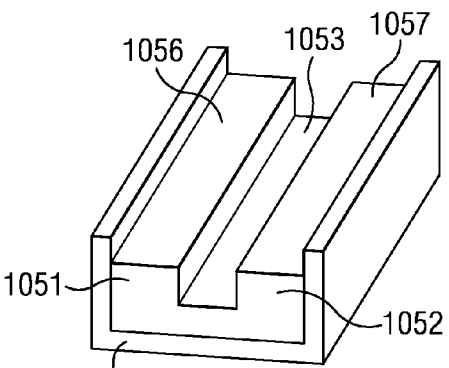
Figure 1E:
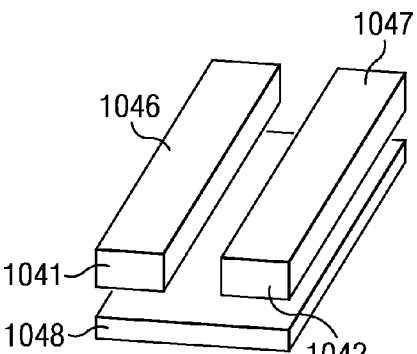
Figure 1D:
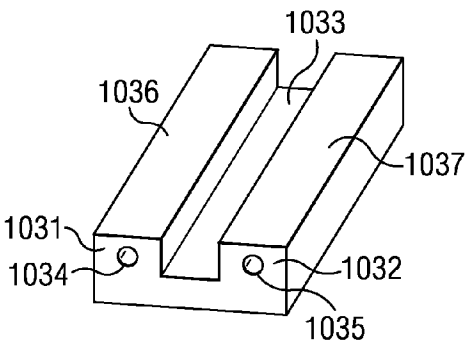

FIG. 1D is a diagram illustrating a rear sight according to at least one example embodiment. The rear sight of FIG. 1D comprises left upward member 1031 having a top surface 1036 and right upward member 1032 having a top surface 1037. There is a separation between left upward member 1031 and right upward member 1032 such that there is a channel 1033 disposed between left upward member 1031 and right upward member 1032. Left upward member 1031 and right upward member 1032 are characterized as upward in that each member extends upward from the height of the bottom of channel 1033. Alignment of the rear sight may be described in terms of alignment of channel 1033, alignment of left upward member 1031, alignment of right upward member 1032, alignment of the upward members, and/or the like.

When the rear sight is aligned along the sighting direction of the shooter, for example along sighting direction 1025 of FIG. 1C, there will be a rear-facing part of left upward member 1031 and a rear-facing part of right upward member 1032 that are proximate the shooter such that each rear-facing part of each upward member can be seen by the eye of the shooter along sighting direction 1024. In the example of FIG. 1C, left upward member 1031 comprises left alignment indicator 1034, and right upward member 1032 comprises right alignment indicator 1035. An alignment indicator on a rear sight is a rear-facing part of the rear sight that is differentiated from the remaining rear-facing parts of the rear sight. The shooter utilizes the rear alignment indicators to vertically align the front sight with the rear sight. The alignment indicator may be differentiated from the rest of the rear-facing part of the rear sight be being a different color than the corresponding upward member, being a surface demarcation of the corresponding upward member, being a different material than the corresponding upward member, and/or the like. The alignment indicator may differ in color by way of paint, dye, color of material, and or the like. A surface demarcation may be a change in surface depth, such as a ridge, a peak, an indentation, a groove, and/or the like. The alignment indicator may be a different material, such as a layer of paint, a light conductive material, a plastic material, and/or the like. For example, an alignment indicator may be a painted circular indentation on a rear-facing part of an upward member. In another example, an alignment indicator may be a horizontal line scored on a rear-facing part of an upward member. In another embodiment, the alignment indicator may be a rear-facing light conductive material. In such an embodiment, light conductive material may be any material that passes light from one surface of the material to another, such as translucent glass, translucent plastic, fiber optical material, and/or the like. Light conducting material may conduct light incident to itself, or may be coupled with a light source, such as a light emitting diode.

In the example of FIG. 1D, the left upward member and the right upward member are substantially parallel to each other. However, in other embodiments, the left upward member and the right upward member may be non-parallel. For example, the left upward member and right upward member may be configured such that the channel therebetween tapers towards the front of the firearm and/or tapers towards the rear of the firearm.

In the example of FIG. 1D, the rear sight relates to a single component that is configured to be shaped as the rear sight. However, in other embodiments, the rear sight may comprise multiple components.

FIG. 1E is a diagram illustrating a rear sight according to at least one example embodiment. In the example of FIG. 1E, the rear sight comprises multiple components. The rear sight comprises left upward member 1041, which has a top surface 1046, right upward member 1042, which has a top surface 1047, and base member 1048. Upon coupling of left upward member 1041 to base member 1048, and coupling of right upward member 1042 to base member 1048, a channel is disposed between left upward member 1041 and right upward member 1042. It should be understood that the example of FIG. 1E is merely an example of a rear sight comprising multiple parts, and that the claims are not limited by the example of FIG. 1E.

FIG. 1F is a diagram illustrating a rear sight within an encasement 1058 according to at least one example embodiment. Under some circumstances, it may be desirable to encase the rear sight. For example, an encasement may provide protection for the sight if the firearm is dropped or stricken at an area that would harm the sight absent the protection of the encasement. The rear sight of FIG. 1F comprises left upward member 1051, which has a top surface 1056, and right member 1052, which has a top surface 1057. The rear sight of FIG. 1F further comprises channel 1053 disposed between left upward member 1051 and right upward member 1052. In the example of FIG. 1F, the rear sight is coupled with encasement 1058. In the example of FIG. 1F, encasement 1058 is a separate part from the rear sight. However, in another example embodiment, the encasement may be part of the rear sight. In such an embodiment, the encasement may still be considered distinctly from the encasement such that the left upward member top surface still refers to top surface 1056 of left upward member 1051, instead of the top surface of the left upward member of the encasement.

Figure 1G:
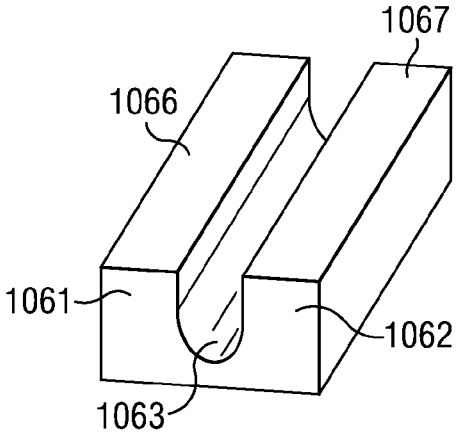

FIG. 1G is a diagram illustrating a rear sight according to at least one example embodiment. The rear sight of FIG. 1G comprises left upward member 1061, which has a top surface 1066, and right upward member 1062, which has a top surface 1067. The rear sight of FIG. 1G further comprises a channel 1063 disposed between left upward member 1061 and right upward member 1062. It can be seen that left upward member top surface 1066 and right upward member top surface 1067 are substantially horizontal. Substantially horizontal refers to the surfaces being within a range of deviation from horizontal alignment that is not noticeable to a shooter.

In the rear sight of FIG. 1G, left upward member 1061 and right upward member 1062 are substantially vertical. Substantially vertical relates to left upward member 1061 and right upward member 1062 being oriented such that they extend upward at an angle that is substantially vertical from the bottom of the rear sight with insubstantial deviation from vertical extension. An insubstantial deviation from vertical extension relates to a deviation that is not noticeable to a shooter. Even though channel 1063 tapers towards the base of the rear sight in a curve, left upward member 1061 and right upward member 1062 are still described as being vertical upward members.

Figure 1H:
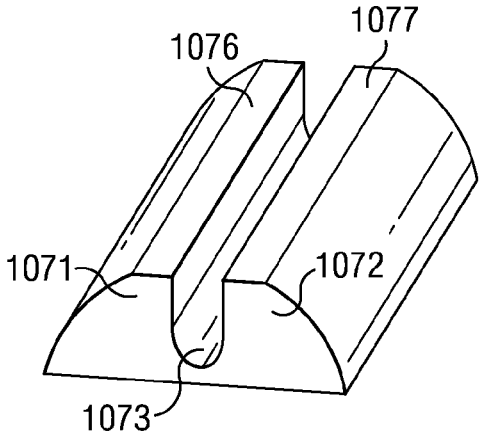

FIG. 1H is a diagram illustrating a rear sight according to at least one example embodiment. The rear sight of FIG. 1H comprises left upward member 1071, which has a top surface 1076, and right upward member 1072, which has a top surface 1077. The rear sight of FIG. 1H further comprises a channel 1073 disposed between left upward member 1071 and right upward member 1072. It can be seen that left upward member top surface 1076 and right upward member top surface 1077 are substantially horizontal.

Figure 1I:
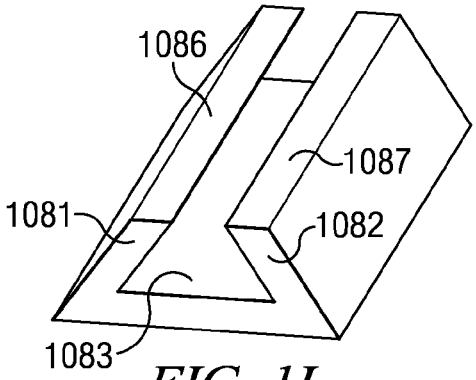

FIG. 1I is a diagram illustrating a rear sight according to at least one example embodiment. The rear sight of FIG. 1I comprises left upward member 1081, which has a top surface 1086, and right upward member 1082, which has a top surface 1087. The rear sight of FIG. 1I further comprises a channel 1083 disposed between left upward member 1081 and right upward member 1082. It can be seen that left upward member top surface 1086 and right upward member top surface 1087 are substantially horizontal.

In the rear sight of FIG. 1I, left upward member 1081 and right upward member 1082 are substantially non-vertical. Substantially non-vertical relates to left upward member 1081 and right upward member 1082 being oriented such that they extend upward at an angle that is substantially non-vertical from the bottom of the rear sight with substantial deviation from vertical extension. A substantial deviation from vertical extension relates to a deviation that is noticeable to a shooter.

Figure 1J:
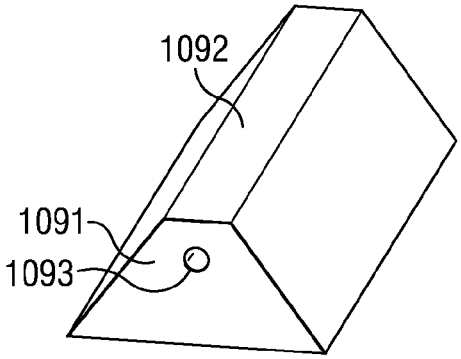

FIG. 1J is a diagram illustrating front sight according to at least one example embodiment. The front sight of FIG. 1J comprises centered upward member 1091. Upward member 1091 is characterized as centered in that top surface 1092 of upward member 1091 is configured to be positioned substantially vertically above the longitudinal axis of a barrel, for example longitudinal axis of the barrel 1028 of FIG. 1C, of the firearm to which the front sight is coupled. Substantially vertically above relates to the center of centered upward member 1091 being substantially vertical from the longitudinal axis of the barrel of the firearm wherein deviation from a vertical is not noticeable by the shooter.

Alignment of the front sight may be described in terms of alignment of centered upward member 1091. When the front sight is aligned along the sighting direction of the shooter, for example along sighting direction 1025 of FIG. 1C, there will be a rear-facing part of centered upward member 1091 that is proximate the shooter such that the rear-facing part of the centered upward member can be seen by the eye of the shooter along the sighting direction. In the example of FIG. 1J, centered upward member 1031 comprises center alignment indicator 1093. An alignment indicator of a front sight is a rear-facing part of the front sight that is differentiated from the remaining rear-facing parts of the front sight. The shooter utilizes the front alignment indicator to vertically align the front sight with the rear sight. The alignment indicator may be differentiated similarly as described with reference to the alignment indicators of FIG. 1D.

Figure 1K:
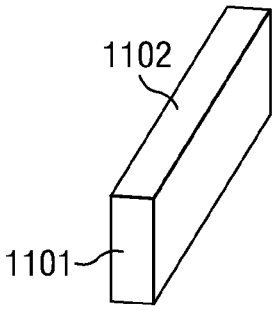

FIG. 1K is a diagram illustrating front sight according to at least one example embodiment. The front sight of FIG. 1K comprises centered upward member 1101. Centered upward member 1101 is substantially vertical in that the member extends from the firearm to which it is coupled in a substantially vertical direction. Substantially vertical from the firearm relates to centered upward member 1101 extending substantially vertically from the firearm wherein deviation from a vertical is not noticeable by the shooter.

Figure 1L:
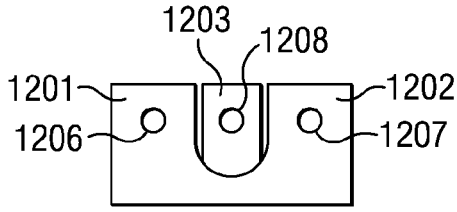

FIG. 1L is a diagram illustrating a rear sight and a front sight according to at least one example embodiment. In the example of FIG. 1L, the front sight and the rear sight are illustrated from a perspective along the sighting direction of the shooter, for example along sighting direction 1025 of FIG. 1C, behind the firearm. The rear sight comprises left upward member 1201, which comprises left alignment indicator 1206, and right alignment indicator 1202, which comprises right alignment indicator 1207. The front sight comprises centered upward member 1203, which comprises center alignment indicator 1208. The centered upward member is configured to be viewed by the shooter through the channel of the rear sight when being aimed by the shooter, for example aimed in the sighting direction of the shooter.

In the example of FIG. 1L, centered upward member 1203 of the front sight is substantially centered within the channel that is disposed between left upward member 1201 and right upward member 1202 of the rear sight. The front sight and rear sight may be configured so that such centering indicates that the output of a barrel of the firearm to which the sights are attached, for example output of the barrel 1026 of FIG. 1C, is substantially horizontally aligned with the sighting direction. For example, substantial deviation of centered upward member 1203 left of center indicates that the output of the barrel of the firearm is at an angle leftward to the sighting direction.

In the example of FIG. 1L, center alignment indicator 1208 of the front sight is substantially level with left alignment indicator 1206 right alignment indicator 1207 of the rear sight. The front sight and rear sight may be configured so that such leveling indicates that the output of a barrel of the firearm to which the sights are attached, for example output of the barrel 1026 of FIG. 1C, is substantially vertically aligned with the sighting direction. For example, substantial deviation of center alignment indicator 1208 above level of left alignment indicator 1206 and right alignment indicator 1207 indicates that the output of the barrel of the firearm is at an angle upward from the sighting direction.

Figure 2A:
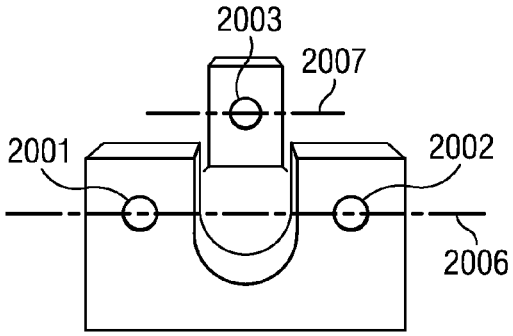
FIGS. 2A-2B are diagrams illustrating aiming with alignment indicators according to at least one example embodiment.
Figure 2B:
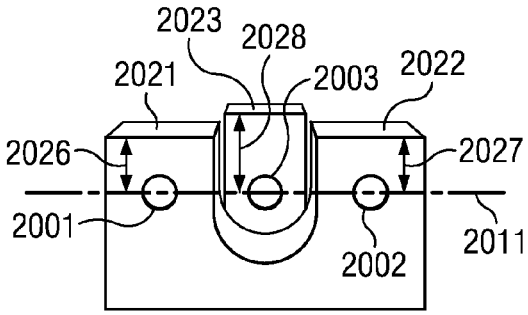

FIGS. 2A-2B are diagrams illustrating aiming with alignment indicators according to at least one example embodiment. The examples of FIGS. 2A-2B are merely examples of aiming with alignment indicators, and do not limit the scope of the claims. For example, shape of the alignment indicators may vary, location of the alignment indicators may vary, configuration of the front sight may vary, configuration of the rear sight may vary, and/or the like.

Some alignment indicators may be non-linear. A linear alignment indicator is an alignment indicator that is in a shape that may be interpreted by the shooter to be a representation of a straight line. Therefore, a non-linear alignment indicator is an alignment indicator that is in a shape that may not be interpreted by the shooter to be a representation of a straight line. A non-linear alignment indicator may be a circle, a triangle, a diamond, a square, and/or the like.

Even though there are many different applications for utilization of firearms, such as sport, law enforcement, military, self-defense, and/or the like, many of these applications share a desire for accuracy in aiming and speed in aiming. For example, in many firearm applications, it may be desirable to aim the firearm quickly. Such an example may relate to aiming at multiple targets within a small amount of time. However, accuracy under such circumstances may be further desirable. Therefore, a shooter may desire to aim both quickly and accurately.

It has been determined that speed and accuracy in aiming and shooting a firearm may be improved by reducing the cognitive work associated with aiming. Although reduction of cognitive work may directly increase speed of aiming, it may also reduce the amount of cognitive fatigue associated with repetitive aiming. For example, as a shooter becomes more cognitively fatigued, the shooter may require increasing deliberation while aiming. Under such circumstances, the speed of aiming may slow more rapidly over repetition of aiming that requires more cognitive work by the shooter.

FIG. 2A is a diagram illustrating aiming with non-linear alignment indicators. In the example of FIG. 2A, the rear sight comprises left alignment indicator 2001 and right alignment indicator 2002, and the front sight comprises center alignment indicator 2003.

It has been determined that aiming with non-linear rear alignment indicators, such as left alignment indicator 2001 and right alignment indicator 2002, comprises a first cognitive step of estimating a line 2006 that extends horizontally between left alignment indicator 2001 and right alignment indicator 2002. It has been further determined that aiming with non-linear rear alignment indicators further comprises a second cognitive step of interpolating the vertical center of left alignment indicator 2001 and interpolating the vertical center of right alignment indicator 2002. It has been further determined that aiming with non-linear rear alignment indicators further comprises a third cognitive step of aligning horizontal line 2006 of the first cognitive step with the interpolated vertical center of left alignment indicator 2001 and the interpolated vertical center of right alignment indicator 2002 of the second cognitive step. It should be understood that the terms first, second, and third are used merely to differentiate cognitive steps, and do not denote any ordering of these steps. For example, some shooters may perform the cognitive steps in the order of first cognitive step, second cognitive step, and third cognitive step, and different shooter may perform the cognitive steps in the order of second cognitive step, first cognitive step, and third cognitive step.

It has been determined that aiming with a non-linear front alignment indicator, such as center alignment indicator 2003, comprises a fourth cognitive step of estimating a line 2007 that extends horizontally outward from center alignment indicator 2003. It has been further determined that aiming with a non-linear front alignment indicator further comprises a fifth cognitive step of interpolating the vertical center of center alignment indicator 2003. It has been further determined that aiming with non-linear front alignment indicator further comprises a sixth cognitive step of aligning horizontal line 2007 of the fourth cognitive step with the interpolated vertical center of center alignment indicator 2001 of the fifth cognitive step. It should be understood that the terms fourth, fifth, and sixth are used merely to differentiate cognitive steps, and do not denote any ordering of these steps. For example, some shooters may perform the cognitive steps in the order of fourth cognitive step, fifth cognitive step, and sixth cognitive step, and different shooter may perform the cognitive steps in the order of fifth cognitive step, fourth cognitive step, and sixth cognitive step.

Furthermore, the ordering of cognitive steps associated with aiming with non-linear rear alignment indicators and cognitive steps associated with aiming with a non-linear front alignment indicator may vary with respect to each other. For example, a shooter may perform cognitive steps associated with the rear sight before cognitive steps associated with the front sight, and a different shooter may perform cognitive steps associated with the front sight before cognitive steps associated with the rear sight. In another example, a shooter may interleave cognitive steps associated with the rear sight with cognitive steps associated with the front sight. In such an example, the shooter may order the cognitive steps second cognitive step, fifth cognitive step, fourth cognitive step, sixth cognitive step, first cognitive step, and third cognitive step.

Upon determining horizontal line 2006 and horizontal line 2007 and their position with respect to their associated alignment indicators, the shooter adjusts the vertical orientation of the firearm so that horizontal line 2006 substantially aligns with horizontal line 2007. It has been further determined that as the shooter performs such adjustment, a shooter may revert to the cognitive steps associated with determining horizontal line 2006 and/or the cognitive steps associated with determining horizontal line 2007 when determining alignment of the adjusted orientation of the firearm. Therefore, as such a shooter adjusts orientation of the firearm, the shooter may continually perform at least some of the six cognitive steps associated with aiming with non-linear alignment indicators.

A shooter may desire to remove, at least some of, these cognitive steps when aiming a firearm. Such removal may reduce cognitive work by the shooter and may improve speed and/or accuracy. A rear sight that provides a left horizontal linear alignment indicator and a right horizontal linear alignment indicator may allow a shooter to eliminate the first, second, and third cognitive steps. This elimination may be accomplished by the left horizontal linear alignment indicator and the right horizontal linear alignment indicator providing an express representation of the horizontal line 2006.

Under circumstances where the center alignment indicator is a non-linear alignment indicator and the left alignment indicator and right alignment indicator are linear alignment indicators, the shooter may avoid the first, second, and third cognitive steps, but may still perform the fourth, fifth, and sixth cognitive steps. Although such circumstances may increase the speed and accuracy of aiming by such cognitive step elimination, speed and accuracy may be further improved when the center alignment indicator is a linear alignment indicator.

A front sight that provides a center horizontal linear alignment indicator may allow the shooter to eliminate the fourth, fifth, and sixth cognitive steps. This elimination may be accomplished by the center horizontal linear alignment indicator providing an express representation of the horizontal line 2007.

A front sight that provides a center horizontal linear alignment indicator in conjunction with a rear sight that provides a left horizontal linear alignment indicator and a right horizontal linear alignment indicator may allow a shooter to eliminate the first, second, third, fourth, fifth, and sixth cognitive steps. This elimination may be accomplished by the center horizontal linear alignment indicator providing an express representation of the horizontal line 2007 in conjunction with the left horizontal linear alignment indicator and the right horizontal linear alignment indicator providing an express representation of the horizontal line 2006. In addition, such configuration of alignment indicators may further allow the shooter to identify vertical alignment of the front sight with the rear sight because alignment of the center alignment indicator with the left horizontal linear alignment indicator and the right horizontal linear alignment indicator becomes an operation of completing a horizontal line instead aligning objects. Therefore, any recalculation associated with adjustment of the firearm may be eliminated.

In addition to allowing a shooter to eliminate such cognitive steps, the linear alignment indicators allow the shooter to vertically narrow the region of focus associated with aligning alignment indicators. The shooter's vertical focus for alignment of alignment indicators is the height of the alignment indicators. Therefore, when such height is decreased to the height of a line, the shooter's vertical focus associated with alignment of alignment indicators is likewise reduced to the height of the line.

There is a trade-off between reducing the height of the horizontal linear alignment indicator and increasing the height of the linear horizontal alignment indicator. The higher that a horizontal linear alignment indicator is, the easier it is for the shooter to see. However, the larger that the horizontal linear alignment indicator is, the less linear, and more rectangular the horizontal linear alignment indicator appears to the shooter.

It has been determined that, a horizontal linear alignment indicator appears to the shooter as a representation of a horizontal line in circumstances where the height of the horizontal linear alignment indicator is less than or substantially equal to ten percent of the width of the horizontal linear alignment indicator. However, it may be desirable for the height of the horizontal linear alignment indicator to be less than or substantially equal to five percent of the width of the horizontal linear alignment indicator. Substantially equal refers to a distance within a range of the value such that the shooter fails to perceive a difference in the value.

In addition, even though it has been determined that a horizontal linear alignment indicator appears to the shooter as a representation of a horizontal line where the height of the horizontal linear alignment indicator is less than or substantially equal to two millimeters, it may be desirable for the height of the horizontal linear alignment indicator to be less than or substantially equal to one millimeter. However, to further emphasize linearity, it may be desirable for the height of the horizontal linear alignment indicator to be less than or substantially equal to five hundred micrometers. Substantially equal refers to a distance within a range of the value such that the shooter fails to perceive a difference in the value.

FIG. 2B is a drawing illustrating an example of a rear sight and a front sight. The rear sight of FIG. 2B comprises a left upward member top surface 2021, a left alignment indicator 2001, a right upward member top surface 2022, and a right alignment indicator 2002. The front sight of FIG. 2B comprises a centered upward member top surface 2023 and a center alignment indicator 2003. Distance 2026 denotes the distance between vertical center of left alignment indicator 2001 and left upward member top surface 2021. Distance 2027 denotes the distance between vertical center of right alignment indicator 2002 and right upward member top surface 2022. Distance 2028 denotes the distance between vertical center of center alignment indicator 2003 and centered upward member top surface 2023.

It has been determined that larger values of distances 2026, 2027, and 2028 relate to more cognitive work of the shooter when aiming. It has been determined that there are several aspects associated with this directly proportional relationship between alignment indicator distance from top surface and cognitive work. One such aspect relates to such distance obscuring the target. Another such aspect relates to increasing the region of focus of the shooter when aiming. Still another such aspect relates to de-emphasis of the alignment indicators.

Larger values of distances 2026, 2027, and 2028 relate to more cognitive work by way of obscuring the target. When the shooter is aiming at a target, any non-zero value for distances 2026, 2027, and 2028 will obscure, at least part of the target. It has been determined that some shooters will compensate for this obscuring by memorizing the target and utilizing such target memorization to interpolate the part of the target obscured by distances 2026, 2027, and 2028. Some shooters perform such memorization and interpolation by performing a prolonged initial examination of the target to memorize the target, and then perform a prolonged alignment interpolation to align the alignment indicators with the interpolated part of the target at which the firearm is being aimed. Other shooters perform an iterative process of briefly viewing the target to provide a vague memorization of the target and aligning the alignment indicators with the vague interpolation allowed by the vague memorization. Such shooters perform subsequent iterations of this process until they reach an acceptable level of confidence in their target interpolation. Each of these processes involves cognitive work by the shooter which results in time spent by the shooter in aiming. Furthermore, each of these processes may increase the cognitive fatigue of the shooter as the shooter performs repetitive aiming.

Larger values of distances 2026, 2027, and 2028 relate to more cognitive work by way of increasing the region of focus of the shooter when aiming. In addition to the memorization and interpolation described above, the focus area of the shooter increases to encompass the alignment indicators and a region above the top surfaces of the upward members that is large enough to allow the shooter to perform the interpolation. For example, a shooter may desire to focus on a part of the target that is large enough to provide adequate basis for performing interpolation of the target. The shooter may rely on such a basis to allow form accurate interpolation. As the region of focus increases, the cognitive work of the shooter increases by way of shifting attention within the focus region. This shifting of attention may be performed to align alignment indicators, to consider visible parts of a target to aid in interpolation, mentally project the interpolated part of the target upon the obscurance of the target, and/or the like. Each of these processes involve cognitive work by the shooter which results in time spent by the shooter in aiming. Furthermore, each of these processes may increase the cognitive fatigue of the shooter as the shooter performs repetitive aiming.

Larger values of distances 2026, 2027, and 2028 relate to more cognitive work by way of relates to de-emphasizing the alignment indicators to the shooter when aiming. In performing the interpolation described above, the region of the upward members associated with distances 2026, 2027, and

2028 become a major emphasis to the shooter. This emphasis may result from the focus of the user associated with interpolation, the fact that fact that this region lies within the center of the focus area of the shooter, and/or the like. This de-emphasis of the alignment indicators may result in the shooter increasing cognitive work associated with maintaining and/or obtaining alignment of the alignment indicators, which may result in time spent by the shooter in aiming, and further increase the cognitive fatigue of the shooter as the shooter performs repetitive aiming.

It may be desirable for a shooter to have linear horizontal alignment indicators at the top of the upward members. For example, it may be desirable for distances 2026, 2027, and 2028 to be substantially zero. Substantially zero relates to a distance that is not noticeable to the shooter. In such an embodiment, there is no region of the target obscured by the upward members, the region of focus extends upward from the alignment indicators only as for as the shooter desires to be able to identify at which part of the target to aim, and there is no de-emphasis of the alignment indicators.

However, it may be desirable for distances 2026, 2027, and 2028 to be non-zero. For example, it may be desirable for such distances to provide a region of the upward members that may protect the alignment indicators from damage resulting in dropping, collision with other objects, and/or the like. When using linear horizontal alignment indicators, it has been determined that a distance between the horizontal linear alignment indicator that is less than or substantially equal to the height of the horizontal linear alignment indicator is sufficient to greatly reduce cognitive work of the shooter when aiming. However, for further efficiency, it may be desirable to have a distance between the horizontal linear alignment indicator that is less than or substantially equal to half of the height of the horizontal linear alignment indicator is sufficient to greatly reduce cognitive work of the shooter when aiming. Significantly equal to the height of the horizontal linear alignment indicator relates to a distance that the shooter perceives to be the height of the linear horizontal alignment indicator. Significantly equal to half of the height of the horizontal linear alignment indicator relates to a distance that the shooter perceives to be half of the height of the linear horizontal alignment indicator.

FIGS. 3A-3I are diagrams illustrating a rear sight with alignment indicators according to at least one example embodiment. The examples of FIGS. 3A-3I are merely examples of a rear sight with alignment indicators, and do not limit the scope of the claims. For example, a rear sight may vary in shape, size, configuration, and/or the like. Furthermore, an alignment indicator may vary by shape, size, orientation, position, and/or the like.

In an example embodiment, the shooter may desire symmetry for the left alignment indicator and the right alignment indicator. For example, it may be desirable for the left alignment indicator and the right alignment indicator to have the same shape, proportions, demarcation, color, material, orientation, position, and/or the like.

Figure 3A:
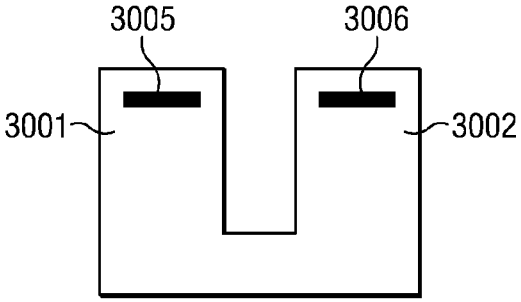
FIGS. 3A-3I are diagrams illustrating a rear sight with alignment indicators according to at least one example embodiment.

FIG. 3A is a diagram illustrating a rear sight according to at least one example embodiment. The rear sight of FIG. 3A comprises a left upward member 3001, a left horizontal linear alignment indicator 3005, a right upward member 3002, and a right horizontal linear alignment indicator 3006.

Figure 3B:
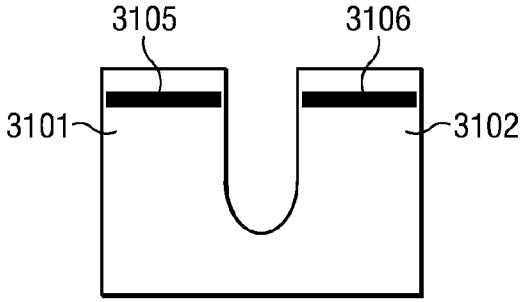

FIG. 3B is a diagram illustrating rear sight according to at least one example embodiment. The rear sight of FIG. 3B comprises a left upward member 3101, a left horizontal linear alignment indicator 3105, a right upward member 3102, and a right horizontal linear alignment indicator 3106. The width of left horizontal linear alignment indicator 3105 extends substantially across the width of left upward member 3105 and the width of right horizontal linear alignment indicator 3106 extends substantially across the width of the right upward member 3102.

In an example embodiment, it may be desirable for the width of left horizontal linear alignment indicator 3105 to extend completely across the width of left upward member 3105 and the width of right horizontal linear alignment indicator 3106 to extend completely across the width of the right upward member 3102. However, it may also be desirable to avoid having edges of the horizontal linear alignment indicators exposed at the edges of the upward members. For example, avoiding such exposure may provide protection for the horizontal linear alignment indicators from damage due to a drop, a collision, and/or the like. Therefore, it may be desirable to provide a distance between each side of a horizontal linear alignment indicator and a respective side of the associated upward member. Therefore, substantially across the width of an upward member relates to a width that may span the entirety of the upward member, a width that spans across the entirety of the upward member less a protective distance from each side of the upward member, and/or any width therebetween.

Figure 3C:
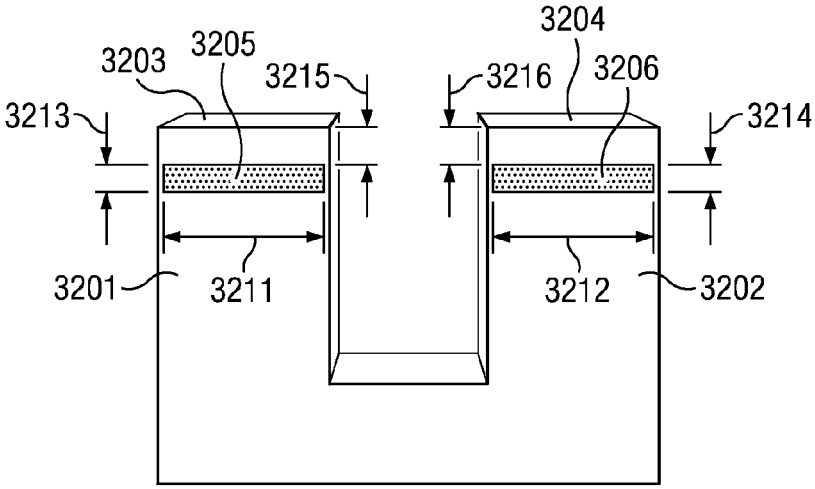

FIG. 3C is a diagram illustrating a rear sight according to at least one example embodiment. The rear sight of FIG. 3C comprises a left upward member 3201, a left horizontal linear alignment indicator 3205, a right upward member 3202, and a right horizontal linear alignment indicator 3206. Left upward member 3201 comprises a top surface 3203. Right upward member 3202 comprises a top surface 3204. The width of left horizontal linear alignment indicator 3205 is denoted by distance 3211. The width of right horizontal linear alignment indicator 3206 is denoted by distance 3212. The height of left horizontal linear alignment indicator 3205 is denoted by distance 3213. The height of right horizontal linear alignment indicator 3206 is denoted by distance 3214. The distance between left horizontal linear alignment indicator 3205 and top surface 3203 of left upward member 3201 is denoted by distance 3215. The distance between right horizontal linear alignment indicator 3206 and top surface 3204 of right upward member 3202 is denoted by distance 3216.

Similar as described with reference to FIG. 2B, distance 3215 may be less than or substantially equal to distance 3213, and/or distance 3216 may be less than or substantially equal to distance 3214. Similarly, distance 3215 may be less than or substantially equal to half of distance 3213, and/or distance 3216 may be less than or substantially equal to half of distance 3214.

Similar as described with reference to FIG. 2B, distance 3213 may be less than or substantially equal to ten percent of distance 3211, and/or distance 3214 may be less than or substantially equal to ten percent of distance 3212. Similarly, distance 3213 may be less than or substantially equal to five percent of distance 3211, and/or distance 3214 may be less than or substantially equal to five percent of distance 3212.

Similar as described with reference to FIG. 2B, distance 3213 may be less than or substantially equal to two millimeters, and/or distance 3214 may be less than or substantially equal to two millimeters. Similarly, distance 3213 may be less than or substantially equal to one millimeter, and/or distance 3214 may be less than or substantially equal to one millimeter. Likewise, distance 3213 may be less than or substantially equal to five hundred micrometers, and/or distance 3214 may be less than or substantially equal to five hundred micrometers.

Figure 3D:
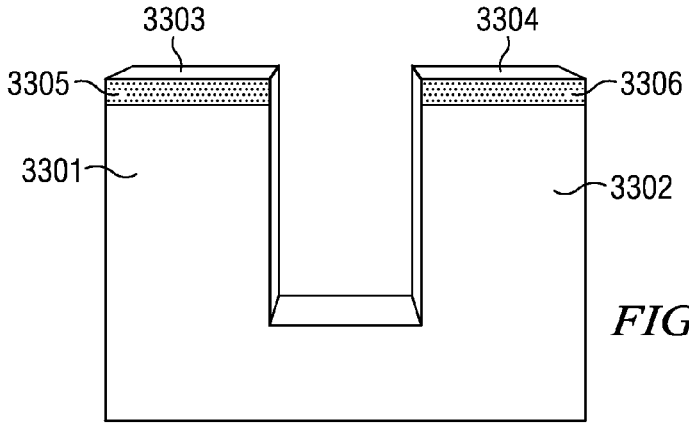

FIG. 3D is a diagram illustrating a rear sight according to at least one example embodiment. The rear sight of FIG. 3D comprises a left upward member 3301, a left horizontal linear alignment indicator 3305, a right upward member 3302, and a right horizontal linear alignment indicator 3306. Left upward member 3301 comprises a top surface 3303. Right upward member 3302 comprises a top surface 3304. The width of left horizontal linear alignment indicator 3305 spans the width of left upward member 3301. The width of right horizontal linear alignment indicator 3306 spans the width of right upward member 3302. Left horizontal linear alignment indicator 3305 is positioned at the top of left upward member 3301 and right horizontal linear alignment indicator 3306 is positioned at the top of the right upward member 3302. Left horizontal linear alignment indicator 3305 may be characterized as positioned at the top of left upward member 3301 due to left horizontal linear alignment indicator 3305 being adjacent to top surface 3303 of left upward member 3301. Right horizontal linear alignment indicator 3306 may be characterized as positioned at the top of right upward member 3302 due to right horizontal linear alignment indicator 3306 being adjacent to top surface 3304 of right upward member 3302.

Figure 3E:
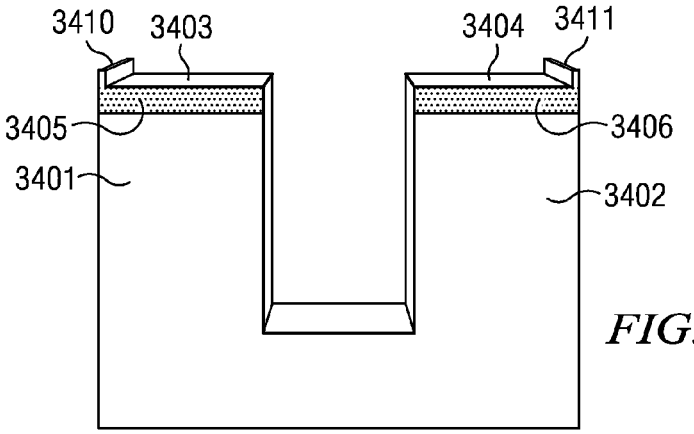

FIG. 3E is a diagram illustrating a rear sight according to at least one example embodiment. The rear sight of FIG. 3E comprises a left upward member 3401, a left horizontal linear alignment indicator 3405, a right upward member 3402, and a right horizontal linear alignment indicator 3406. Left upward member 3401 comprises a top surface 3403. Right upward member 3402 comprises a top surface 3404. The width of left horizontal linear alignment indicator 3405 spans the width of left upward member 3401. The width of right horizontal linear alignment indicator 3406 spans the width of right upward member 3402. Left horizontal linear alignment indicator 3405 is positioned at the top of left upward member 3401 and right horizontal linear alignment indicator 3406 is positioned at the top of the right upward member 3402. Left horizontal linear alignment indicator 3405 may be characterized as positioned at the top of left upward member 3401 due to left horizontal linear alignment indicator 3405 being adjacent to top surface 3403 of left upward member 3401. Right horizontal linear alignment indicator 3406 may be characterized as positioned at the top of right upward member 3402 due to right horizontal linear alignment indicator 3406 being adjacent to top surface 3404 of right upward member 3402.

It may be desirable to protect the top positioned horizontal linear alignment indicators of FIG. 3E with an outer upward extension of the upward members beyond the top surfaces of the upward members. FIG. 3E illustrates outer upward extension 3410, which extend beyond the top surface 3403 of left upward member 3401. Under such configuration, top surface 3403 is still considered to be the top surface of left upward member 3401 because top surface 3403 constitutes the majority of the top surface of left upward member 3401. The majority of the top surface relates to a surface area that constitutes at least half of the surface area of the top surface of an upward member. FIG. 3E illustrates outer upward extension 3411, which extend beyond the top surface 3404 of right upward member 3402. Under such configuration, top surface 3404 is still considered to be the top surface of right upward member 3402 because top surface 3404 constitutes the majority of the top surface of right upward member 3402.

Figure 3F:
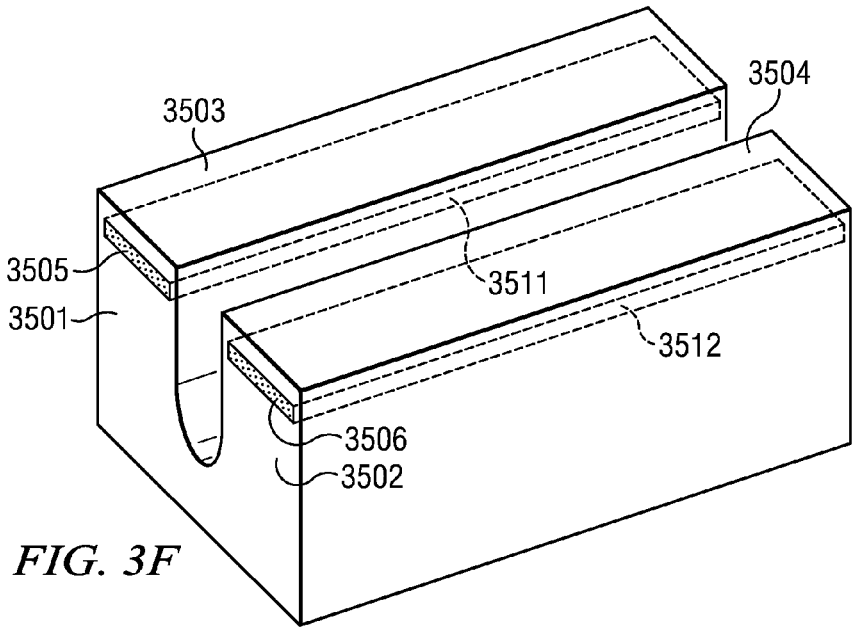

FIG. 3F is a diagram illustrating rear sight according to at least one example embodiment. The rear sight of FIG. 3F comprises a left upward member 3501, a left horizontal linear alignment indicator 3505, a right upward member 3502, and a right horizontal linear alignment indicator 3506. Left upward member 3501 comprises a top surface 3503. Right upward member 3502 comprises a top surface 3504. Left horizontal linear alignment indicator 3505 comprises light conductive material 3511. The light conductive material 3511 extends from the rear face of the rear sight to the front face of the rear sight so that the light conductive material 3511 may conduct light from the end of the light conductive material 3511 at the front face of the rear sight to the end of the light conductive material 3511 at the rear face of the rear sight. Light conductive material 3511 is encased at its sides within left upward member 3501. Right horizontal linear alignment indicator 3506 comprises light conductive material 3512. The light conductive material 3512 extends from the rear face of the rear sight to the front face of the rear sight so that the light conductive material 3512 may conduct light from the end of the light conductive material 3512 at the front face of the rear sight to the end of the light conductive material 3512 at the rear face of the rear sight. Light conductive material 3512 is encased at its sides within right upward member 3502.

Figure 3G:
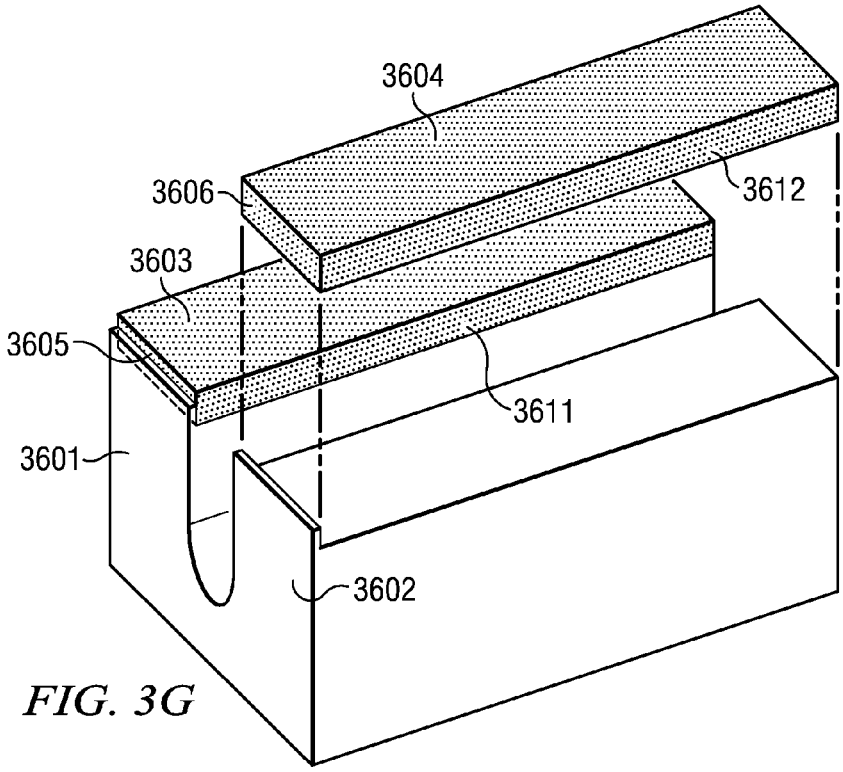

FIG. 3G is a diagram illustrating of a rear sight according to at least one example embodiment. The rear sight of FIG. 3G comprises a left upward member 3601, a left horizontal linear alignment indicator 3605, a right upward member 3602, and a right horizontal linear alignment indicator 3606. Left upward member 3601 comprises a top surface 3603. Right upward member 3602 comprises a top surface 3604. Left horizontal linear alignment indicator 3605 comprises light conductive material 3611. The light conductive material 3611 extends from the rear face of the rear sight to the front face of the rear sight so that the light conductive material 3611 may conduct light from the end of the light conductive material 3611 at the front face of the rear sight to the end of the light conductive material 3611 at the rear face of the rear sight. Part of light conductive material 3611 is obstructed at the rear face of the rear sight such that the exposed part of light conductive material 3611 is a horizontal linear alignment indicator. It should be understood that the cross-sectional shape of light conductive material 3611 may vary across embodiments. For example, the cross sectional area of light conductive material may be shaped to provide a lip that prevents upward slippage. Light conductive material 3603 is positioned at the top of left upward member 3601.

Right horizontal linear alignment indicator 3606 comprises light conductive material 3612. The light conductive material 3612 extends from the rear face of the rear sight to the front face of the rear sight so that the light conductive material 3612 may conduct light from the end of the light conductive material 3612 at the front face of the rear sight to the end of the light conductive material 3612 at the rear face of the rear sight. Part of light conductive material 3612 is obstructed at the rear face of the rear sight such that the exposed part of light conductive material 3612 is a horizontal linear alignment indicator. It should be understood that the cross-sectional shape of light conductive material 3612 may vary across embodiments. For example, the cross sectional area of light conductive material may be shaped to provide a lip that prevents upward slippage. Light conductive material 3604 is positioned at the top of left upward member 3602.

Figure 3H:
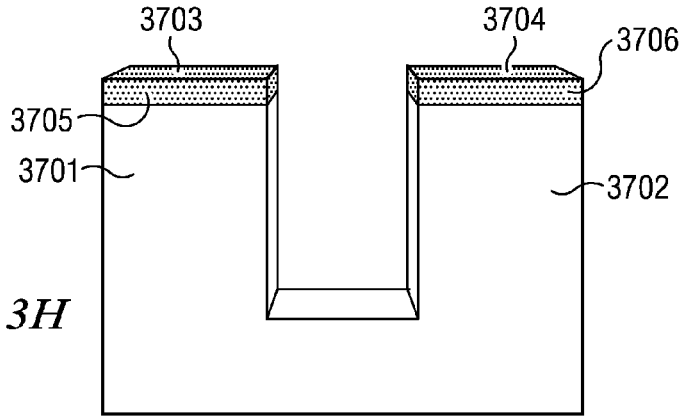

FIG. 3H is a diagram illustrating according to at least one example embodiment. The rear sight of FIG. 3H comprises a left upward member 3701, a left horizontal linear alignment indicator 3705, a right upward member 3702, and a right horizontal linear alignment indicator 3706. Left upward member 3701 comprises a top surface 3703. Right upward member 3702 comprises a top surface 3704. The width of left horizontal linear alignment indicator 3705 spans the width of left upward member 3701. The width of right horizontal linear alignment indicator 3706 spans the width of right upward member 3702. Left horizontal linear alignment indicator 3705 is positioned at the top of left upward member 3701 and right horizontal linear alignment indicator 3706 is positioned at the top of the right upward member 3702. Left horizontal linear alignment indicator 3705 may be characterized as positioned at the top of left upward member 3701 due to left horizontal linear alignment indicator 3705 being adjacent to top surface 3703 of left upward member 3701. Right horizontal linear alignment indicator 3706 may be characterized as positioned at the top of right upward member 3702 due to right horizontal linear alignment indicator 3706 being adjacent to top surface 3704 of right upward member 3702. Top surface 3703 of left upward member 3701 comprises similar demarcation to the demarcation of left horizontal linear alignment indicator 3705. In an example embodiment, the demarcation of left horizontal linear alignment indicator 3705 and top surface 3703 is paint. In such an embodiment, the height of left horizontal linear alignment indicator 3705 may be the thickness of paint disposed on top surface 3703. Top surface 3704 of right upward member 3702 comprises similar demarcation to the demarcation of right horizontal linear alignment indicator 3706. In an example embodiment, the demarcation of right horizontal linear alignment indicator 3706 and top surface 3704 is paint. In such an embodiment, the height of right horizontal linear alignment indicator 3706 may be the thickness of paint disposed on top surface 3704.

Figure 3I:
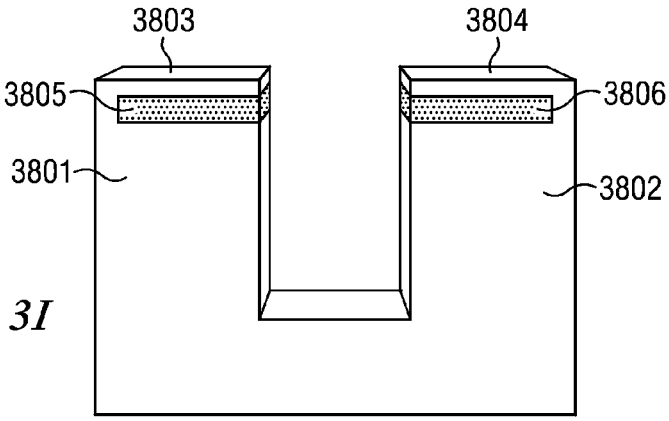

FIG. 3I is a diagram illustrating a rear sight according to at least one example embodiment. The rear sight of FIG. 3A comprises a left upward member 3801, a left horizontal linear alignment indicator 3805, a right upward member 3802, and a right horizontal linear alignment indicator 3806. Left upward member 3801 comprises a top surface 3803. Right upward member 3802 comprises a top surface 3804. Left horizontal linear alignment indicator 3805 extends to the right side of left upward member 3801. Right horizontal alignment indicator 3806 extends to the left side of right upward alignment indicator 3802.

It may be desirable to protect the outer part of the horizontal linear alignment indicator while providing horizontal linear alignment indicators that extend to the inner edge of the upward members. Such an embodiment may provide protection to the horizontal linear alignment indicator, while eliminating inward interruption of the horizontal linear alignment indicator.

Figure 4A:
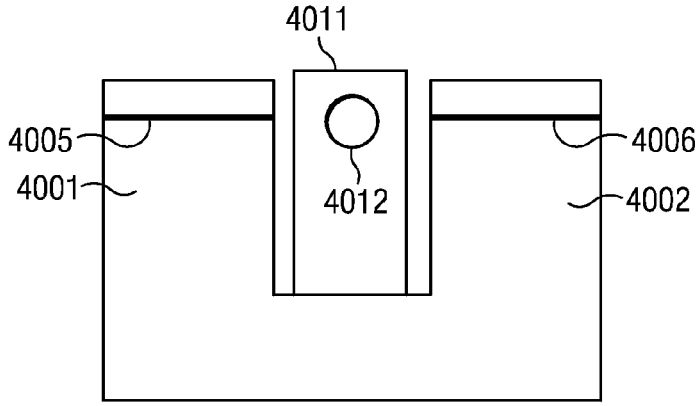
FIGS. 4A-4C are diagrams illustrating a front sight and a rear sight with alignment indicators according to at least one example embodiment.
Figure 4B:
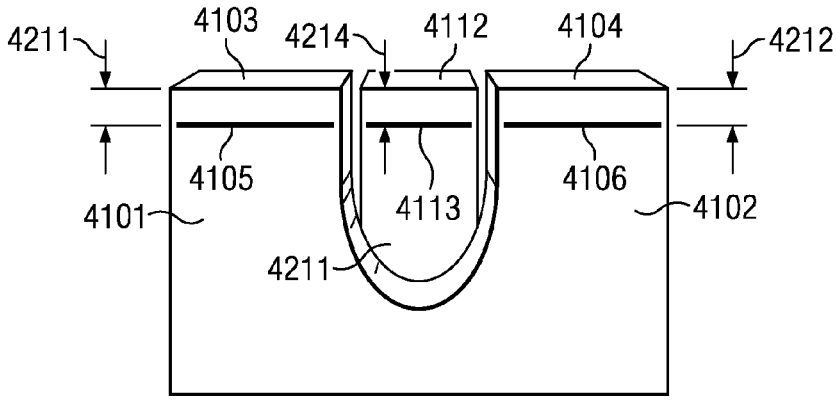
Figure 4C:
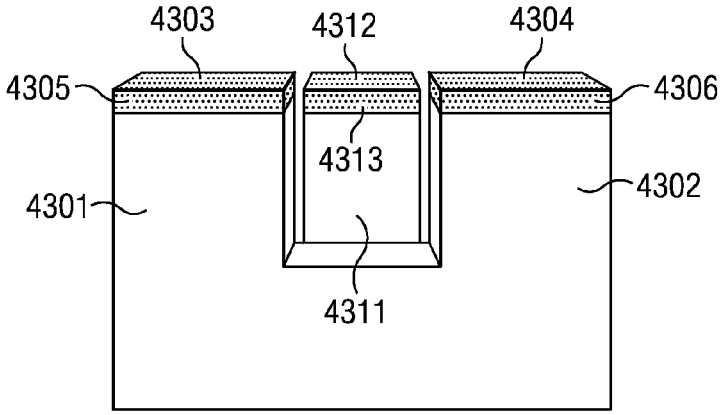

FIGS. 4A-4C are diagrams illustrating a front sight and a rear sight with alignment indicators according to at least one example embodiment. The examples of FIGS. 4A-4C are merely examples of a front sight with alignment indicators, and do not limit the scope of the claims. For example, a front sight may vary in shape, size, configuration, and/or the like. Furthermore, an alignment indicator may vary by shape, size, orientation, position, and/or the like.

In the examples of FIGS. 4A-4C, the front sight and the rear sight are illustrated from a perspective along the sighting direction of the shooter, for example along sighting direction 1025 of FIG. 1C, behind the firearm. An alignment indicator of the front sight, if any, may be similar to at least one of the alignment indicators of the rear sight. For example the alignment indicator of the front sight may differ by color, shape, size, width, height, and/or the like. The alignment indicator may be similar as described with reference to alignment indicators described with reference to FIGS. 3A-3I.

FIG. 4A is a diagram illustrating a front sight and a rear sight according to at least one example embodiment. The rear sight of FIG. 4A comprises left upward member 4001, left horizontal linear alignment indicator 4005, right upward member 4002, and right horizontal linear alignment indicator 4006. The rear sight may be similar as described with reference to FIGS. 3A-3I. The front sight of FIG. 4A comprises centered upward member 4011 and center alignment indicator 4012.

FIG. 4B is a diagram illustrating a front sight and a rear sight according to at least one example embodiment. The rear sight of FIG. 4B comprises a left upward member 4101, a left horizontal linear alignment indicator 4105, a right upward member 4102, and a right horizontal linear alignment indicator 4106. Left upward member 4101 comprises a top surface 4103. Right upward member 4102 comprises a top surface 4104. The distance between left horizontal linear alignment indicator 4105 and top surface 4103 of left upward member 4101 is denoted by distance 4211. The distance between right horizontal linear alignment indicator 4106 and top surface 4104 of right upward member 4102 is denoted by distance 4212. The front sight of FIG. 4B comprises centered upward member 4211 and center alignment indicator 4113. Centered upward member 4211 comprises top surface 4112. The distance between center horizontal linear alignment indicator 4113 and top surface 4112 is denoted by distance 4214. In an example embodiment, the value of distance 4214 is substantially equal to at least one of the value of distance 4211 or the value of distance 4212. The values may be substantially equal in that variation of from equality is not noticeable by the shooter of the firearm. Center horizontal linear alignment indicator may be positioned proximate to top surface 4112 of the centered upward member 4211. Proximate to the top surface may relate to distance 4214 being less than or substantially equal to the height of center horizontal linear alignment indicator 411, similar as described with reference to FIG. 2B. Center horizontal linear alignment indicator 4113 may extend substantially across the width of the centered upward member. Substantially across the width may be similar as described with reference to FIG. 3B.

FIG. 4C is a diagram illustrating a front sight and a rear sight according to at least one example embodiment. The rear sight of FIG. 4C comprises a left upward member 4301, a left horizontal linear alignment indicator 4305, a right upward member 4302, and a right horizontal linear alignment indicator 4106. Left upward member 4101 comprises a top surface 4303. Right upward member 4302 comprises a top surface 4304. The front sight of FIG. 4C comprises centered upward member 4311 and center alignment indicator 4313. Centered upward member 4311 comprises top surface 4312. Center horizontal linear alignment indicator is position at the top of centered upward member 4311. being positioned at the top of an upward member may be similar as described with reference to FIG. 3D.

Top surface 4303 of left upward member 4301 comprises similar demarcation to the demarcation of left horizontal linear alignment indicator 4305. In an example embodiment, the demarcation of left horizontal linear alignment indicator 4305 and top surface 4303 is paint. In such an embodiment, the height of left horizontal linear alignment indicator 4305 may be the thickness of paint disposed on top surface 4303.

Top surface 4304 of right upward member 4302 comprises similar demarcation to the demarcation of right horizontal linear alignment indicator 4306. In an example embodiment, the demarcation of right horizontal linear alignment indicator 4306 and top surface 4304 is paint. In such an embodiment, the height of right horizontal linear alignment indicator 4306 may be the thickness of paint disposed on top surface 4304.

Top surface 4312 of centered upward member 4311 comprises similar demarcation to the demarcation of center horizontal linear alignment indicator 4313. In an example embodiment, the demarcation of center horizontal linear alignment indicator 4313 and top surface 4312 is paint. In such an embodiment, the height of center horizontal linear alignment indicator 4313 may be the thickness of paint disposed on top surface 4312.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are variations and modifications which may be made without departing from the scope of the present invention as defined in the appended claims.

What is claimed is:

1. An apparatus comprising:

a rear sight configured to be coupled with a firearm, the rear sight comprising:

a left upward member and a right upward member with a channel disposed therebetween, the left upward member comprising a left horizontal linear alignment indicator and the right upward member comprising a right horizontal linear alignment indicator, wherein a distance between the left horizontal linear alignment indictor and a top surface of the left upward member is less than or substantially equal to the height of the left horizontal linear alignment indicator and a distance between the right horizontal linear alignment indictor and a top surface of the right upward member is less than or substantially equal to the height of the right horizontal linear alignment indicator, wherein the left horizontal linear alignment indicator is a different material than the left upward member and the right linear alignment indicator is a different material than the right upward member; and a front sight configured to be coupled with the firearm, the front sight comprising:

a centered upward member comprising a center horizontal linear alignment indicator, wherein distance between the center horizontal linear alignment indictor and a top surface of the centered upward member is less than or substantially equal to the height of the center horizontal linear alignment indicator.

2. The apparatus of claim 1, wherein the distance between the left horizontal linear alignment indictor and the top surface of the left upward member is less than or substantially equal to half of the height of the left horizontal linear alignment indicator and the distance between the right horizontal linear alignment indictor and the top surface of the right upward member is less than or substantially equal to half of the height of the right horizontal linear alignment indicator.

3. The apparatus of claim 1, wherein the left horizontal linear alignment indicator is positioned at the top of the left upward member and the right horizontal linear alignment indicator is positioned at the top of the right upward member.

4. The apparatus of claim 1, wherein the left horizontal linear alignment indicator extends to the right side of the left upward member and the right horizontal alignment indicator extends to the left side of the right upward alignment indicator.

5. The apparatus of claim 1, wherein the width of the left horizontal linear alignment indicator extends substantially across the width of the left upward member and the width of the right horizontal linear alignment indicator extends substantially across the width of the right upward member.

6. The apparatus of claim 1, wherein the height of the left horizontal linear alignment indicator is less than or substantially equal to ten percent of the width of the left horizontal linear alignment indicator and the height of the right horizontal linear alignment indicator is less than or substantially equal to ten percent of the width of the right horizontal linear alignment indicator.

7. The apparatus of claim 6, wherein the height of the left horizontal linear alignment indicator is less than or substantially equal to five percent of the width of the left horizontal linear alignment indicator and the height of the right horizontal linear alignment indicator is less than or substantially equal to five percent of the width of the right horizontal linear alignment indicator.

8. The apparatus of claim 1, wherein the height of the left horizontal linear alignment indicator is less than or substantially equal to two millimeters and the height of the right horizontal linear alignment indicator is less than or substantially equal to two millimeters.

9. The apparatus of claim 8, wherein the height of the left horizontal linear alignment indicator is less than or substantially equal to one millimeter and the height of the right horizontal linear alignment indicator is less than or substantially equal to one millimeter.

10. The apparatus of claim 1, wherein the left horizontal linear alignment indicator and the right horizontal linear alignment indicator comprise light-conductive material.

11. The apparatus of claim 1, wherein distance between the center horizontal linear alignment indicator and the top surface of the centered upward member is substantially equal to the distance between the left horizontal linear alignment indicator and the top surface of the left upward member.

12. The apparatus of claim 1, wherein the width of the center horizontal linear alignment indicator extends substantially across the width of the centered upward member.

13. The apparatus of claim 1, further comprising the firearm, wherein the rear sight is coupled with the firearm and the front sight is coupled with the firearm.

14. The apparatus of claim 1, wherein the apparatus is a handgun.

15. The apparatus of claim 1, wherein the left upward member is substantially vertical and the right upward member is substantially vertical.

16. The apparatus of claim 1, wherein the centered upward member is substantially vertical.

17. The apparatus of claim 1, wherein the center horizontal linear alignment indicator is positioned proximate to the top surface of the centered upward member.

18. The apparatus of claim 1, wherein the channel is substantially vertical.

19. The apparatus of claim 1, wherein the top surface of the centered upward member is substantially horizontal.

20. The apparatus of claim 1, wherein the center horizontal linear alignment indicator is a different material than the centered upward member.

21. The apparatus of claim 20, wherein the material of the center horizontal linear alignment indicator is at least partially obstructed by the rear face of the centered upward member.

22. The apparatus of claim 1, wherein the material of the left horizontal linear alignment indicator is at least partially obstructed by the rear face of left upward member, and the material of the right horizontal linear alignment indicator is at least partially obstructed by the rear face of the right upward member.

* * * * *